US009521707B2

(12) United States Patent
Weerapakkaroon et al.

(10) Patent No.: US 9,521,707 B2
(45) Date of Patent: Dec. 13, 2016

(54) ELECTROMAGNETIC OIL TANK HEATING UNIT

(71) Applicant: PTT Public Company Limited, Bangkok (TH)

(72) Inventors: Wichapun Weerapakkaroon, Bangkok (TH); Cherdpong Jomdecha, Bangkok (TH); Dayin Jearsiripongkul, Bangkok (TH); Chalermkiat Jirarungsatian, Bangkok (TH)

(73) Assignee: PTT Public Company Limited, Bangkok (TH)

( * ) Notice: Subject to any disclaimer, the term of this patent is extended or adjusted under 35 U.S.C. 154(b) by 909 days.

(21) Appl. No.: 13/859,288

(22) Filed: Apr. 9, 2013

(65) Prior Publication Data

US 2014/0299594 A1 Oct. 9, 2014

(51) Int. Cl.
*H05B 6/10* (2006.01)
*B67D 7/82* (2010.01)

(52) U.S. Cl.
CPC ..... *H05B 6/108* (2013.01); *B67D 7/82* (2013.01); *H05B 2214/03* (2013.01)

(58) Field of Classification Search
CPC combination set(s) only.
See application file for complete search history.

(56) References Cited

U.S. PATENT DOCUMENTS 1,914,585 A * 6/1933 Smith ..... B65D 88/744 165/142
2,886,690 A * 5/1959 Crawford ..... B23K 1/002 219/615
3,176,764 A * 4/1965 La Barbera ..... B65D 88/744 105/360
3,228,466 A * 1/1966 Carleton ..... B65D 88/744 105/247
3,596,036 A * 7/1971 Ross ..... H05B 6/02 219/646

(Continued)

FOREIGN PATENT DOCUMENTS

CN 201657384 11/2010
CN 201753171 3/2011

(Continued)

*Primary Examiner* — Dana Ross
*Assistant Examiner* — Renee Larose
(74) *Attorney, Agent, or Firm* — Kim Winston LLP

(57) ABSTRACT

An electromagnetic oil tank heating unit and an electromagnetic oil tank heating system comprising multiple units of electromagnetic oil tank heating units is provided. Each electromagnetic oil tank heating unit comprises a generator capable of generating high frequency electrical current connected to a transformer and a cooling unit, an induction plate with induction coil embedded therein, connected to the transformer and at least one cooling unit, providing cooling to the transformer and the induction plate. The generator, the transformer, the induction plate and the cooling unit are arranged on a frame equipped with wheels to permit mobility of the unit to allow moving the heating unit to a specific location along the length of an oil tank. The frame is configured to include a mechanical means allowing the induction plate supported thereon to move up and down, and forward and backward relative to the oil tank.

17 Claims, 11 Drawing Sheets

(56) References Cited

U.S. PATENT DOCUMENTS 3,705,285 A * 12/1972 Cachat ..... C21D 9/70 219/646
4,300,031 A * 11/1981 Reboux ..... B23K 13/00 219/617
4,414,462 A * 11/1983 Price ..... B61D 5/02 105/358
5,122,363 A * 6/1992 Balkus, Jr. ..... A61K 49/1893 424/684
5,186,755 A * 2/1993 Carlson, Jr. ..... B05B 13/0436 118/307
5,337,858 A * 8/1994 Neubauer ..... B66B 9/16 182/145
5,468,117 A * 11/1995 Lobko ..... B60P 3/2295 105/451
5,872,352 A * 2/1999 Suganuma ..... B22D 17/007 164/513
6,302,961 B1 * 10/2001 Robie ..... B05B 13/0242 118/315
6,911,089 B2 * 6/2005 Latvis ..... B05C 9/14 118/666
6,956,189 B1 * 10/2005 Verhagen ..... H05B 6/06 174/15.6
7,405,380 B2 * 7/2008 Obata ..... H05B 6/36 219/603
7,491,916 B1 * 2/2009 Barber ..... B23K 3/04 156/380.2
7,858,908 B2 * 12/2010 Wallace ..... A61L 2/04 219/200
7,963,230 B2 * 6/2011 Simpson ..... B61D 5/00 105/358
8,038,931 B1 * 10/2011 Thomas ..... H05B 6/101 219/632
2011/0084063 A1 * 4/2011 Bollman ..... C21D 1/10 219/660

FOREIGN PATENT DOCUMENTS

CN 201842413 5/2011
CN 202328726 7/2012

* cited by examiner

ELECTROMAGNETIC OIL TANK HEATING UNIT

FIELD OF THE INVENTION

The present invention relates to engineering, more specifically in the field of an electromagnetic oil tank heating unit.

BACKGROUND OF THE INVENTION

One of the main challenges in oil production is the transportation and unloading of viscous heavy oil. Once the shipment of heavy oil has arrived at its destination, unloading can take a considerable amount of time due to the viscosity nature of the oil. Increasing temperature in order to reduce viscosity of the oil is one of the most common methods for reducing viscosity of the heavy oil and this accelerates unloading of the oil. Hence, several means and methods, including electromagnetic heating have been suggested.

CN201842413 discloses an electromagnetic heating device with an oil storage tank as provided with bases, a heat preservation layer, an electromagnetic induction plate, the oil storage tank and an oil outlet. The oil outlet is mounted on the lateral surface of the lower portion of the oil storage tank. The three bases are placed evenly and the electromagnetic induction plate is arranged among the bases. The heat preservation layer is distributed below the electromagnetic induction plate.

CN201753171 discloses an integrated induction heating type oil storage tank system comprising a temperature controller, an alternating current power supply, an induction heating coil and a ferromagnetic oil storage tank. The alternating current power supply and the induction heating coil form a heating loop, and a sensor of the temperature controller is connected to a control end of the alternating current power supply. Cables of the induction heating coil are laid on the outer side of the oil storage tank and the tank body of the oil storage tank is connected with the ground.

CN202328726 discloses an induction type fluid heating furnace. The induction type fluid heating furnace comprises an induction coil and magnet-yoke magnetizers which are fixed on the induction heating coil, wherein a heating pipe is arranged on an inner layer of the induction heating coil. A fluid inlet and a fluid outlet end are arranged at two ends of the heating pipe. The temperature of the heating pipe is less than 760° C. Alternating induction current is applied to the induction heating coil. The heating pipe is heated through electromagnetic induction and then exchange heated with the internal fluid so an effect of heating the fluid is achieved. The magnet-yoke magnetizers are arranged on the outer part of the induction heating coil to improve heating efficiency and suppressed magnetic leakage loss. Temperature detection thermoelectric couplers are arranged on the heating pipe and at the fluid inlet and outlet end to detect temperature of the fluid.

CN201657384 discloses an electromagnetic induction wire plate comprising a cover board, a bottom board, a cable wound between the cover board and the bottom board, a plurality of locking pieces for locking the cover board and the bottom board. The cover board and the bottom board are in a shape of an arched elongated plate. The cover board is overlapped on the bottom board and the locking pieces lock the cover board and the bottom board.

It is an object of the present invention to provide an alternative electromagnetic oil tank heating unit and electromagnetic oil tank heating system to reduce viscosity of heavy oil.

SUMMARY OF THE INVENTION

The present invention is directed to an electromagnetic oil tank heating unit and an electromagnetic oil tank heating system which provides non-contact heating between the heating unit and the oil tank.

In one aspect of the invention, the invention provides a mobile electromagnetic oil tank heating unit. In one preferred embodiment of the invention, the invention provides a mobile electromagnetic oil tank heating unit comprising a generator capable of generating high frequency electrical current connected to a transformer, an induction plate with an induction coil embedded therein connected to the transformer and at least one cooling unit providing cooling to the transformer and the induction plate. The generator, the transformer, the induction plate and the cooling unit are arranged on a frame equipped with wheels to permit mobility of the unit so as to allow moving the heating unit to a specific location along the length of the oil tank. The frame is configured to include a moving means allowing the induction plate to move up and down, and forward and backward relative to an oil tank.

In another aspect of the invention, the invention provides a stationary electromagnetic oil tank heating system. In one preferred embodiment, the invention provides a stationary electromagnetic oil tank heating system comprising multiple electromagnetic oil tank heating units, of which each comprises a generator, a transformer, an induction plate and a cooling unit having most of the features as described in the embodiments of the first aspect of the invention. This aspect of the electromagnetic oil tank heating system aims to provide heating to the entire length of the oil tank at one time. In another preferred embodiment, the generator, the transformer and the cooling unit are arranged in a central station away from the induction plate supported on the frame.

BRIEF DESCRIPTION OF DRAWINGS

Advantages and characteristics of the present invention will be appreciated from the following description, in which, as a non-limiting example, some preferable embodiments of the principle of the invention are described, with reference to the accompanying drawings, in which.

DETAILED DESCRIPTION OF THE INVENTION

Figure 1:
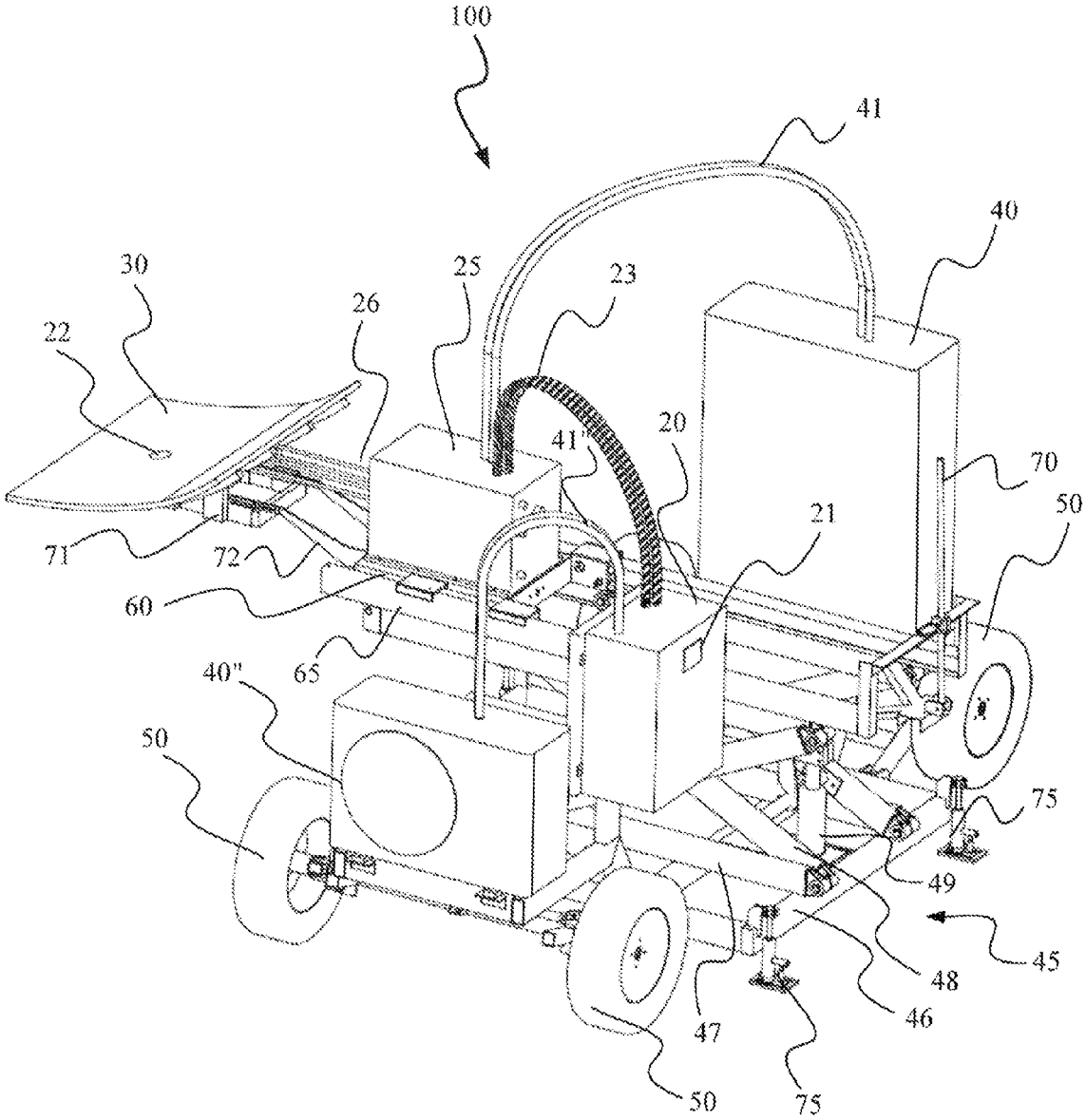
FIG. 1 shows a perspective view of an embodiment of an electromagnetic oil tank heating unit according to the principle of the present invention.

In one aspect of the invention, the present invention provides a mobile electromagnetic oil tank heating unit configured to heat heavy oil contained inside an oil tank. In another aspect of the invention, the present invention provides a stationary electromagnetic oil tank heating system configured to heat heavy oil contained inside an oil tank. Each aspect of the invention will now be described in detail in reference to accompanying drawings illustrating various embodiments of the invention.

In the first aspect of the invention, the invention provides a mobile electromagnetic oil tank heating unit, of which provides non-contact heating between the heating unit and an oil tank to heat the heavy oil contained therein so as to reduce viscosity of the oil to enhance flowability of the oil during unloading. The electromagnetic oil tank heating unit effectively heats the oil tank of which such heat is transferred to the heavy oil contained in the oil tank without having the need to modify the oil tank or the need to install the heating device to the oil tank.

FIGS. 1 and 2-4 show an embodiment of an electromagnetic oil tank heating unit 100 according to the principle of the present invention. In this preferred embodiment, the electromagnetic oil tank heating unit 100 is intended to be mobile and comprising a generator 20 capable of generating high frequency electrical current connected to a transformer 25 and a cooling unit 40 or 40", an induction plate 30, with induction coil 35 embedded therein, connected to the transformer 25 and at least one cooling unit 40, 40" providing cooling liquid to the transformer 25 and the induction plate 30. The generator 20, the transformer 25, the induction plate 30 and the cooling unit 40, 40" are arranged on a frame 45 equipped with wheels 50 to permit mobility of the unit so as to allow moving the heating to a specific location along the length of an oil tank 55. The frame 45 is configured to include mechanical means allowing the frame and thus the induction plate 30 supported thereon to move up and down, and forward and backward relative to the oil tank 55.

In more detail, the generator 20 is capable of generating high voltage with high frequency to the transformer 25. The capacity of the generator 20 determines the level of frequency and the amount of output voltage which correlate to the ability to generate heat at the induction plate 30 and hence affect the time frame by which required to heat the oil tank 55. Therefore, it is desirable to be able to control the level of output voltage in order to attain an optimum time frame for heating while minimizing power consumption of the generator 20. Therefore, according to the principle of the present invention, the generator 20 is connected by a high voltage cable 23 to the transformer 25 of which supplies the current to the induction coil 35 and regulates impedance of the induction coil 35 within the induction plate 30 to correspond with the output voltage generated by the generator 20. The output voltage can be adjusted by way of a temperature control unit 21 in the generator 20. The heating temperature is regulated by way of a temperature sensor 22 disposed on the induction plate 30. The temperature sensor 22 at the induction plate 30 detects the temperature at the time of heating and sends the read temperature to the temperature control unit 21 of generator 20 and thus the output voltage is adjusted. The transformer 25 transforms the high voltage generated by the generator 20 into high current output in order to supply the induction coil 35 within the induction plate 30.

The cooling unit 40, 40" supply cooling fluid, for example, water, to the generator 20 via flexible water tube 41,41", the transformer 25 and subsequently to the induction coil 35. The cooling unit is a closed unit wherein cooling fluid, i.e. water is added into the unit and circulates within the unit and the circulation and the pressure of the cooling fluid is regulated with assistance of a water pump (not shown) disposed within the unit to regulate water pressure. The cooling fluid exits the cooling unit and continuously and simultaneously enters the transformer 25 and the induction coil 35 to provide cooling to the transformer 25 and the induction coil 35. The returning cooling fluid is cooled down again with coolant or any other known means, at the cooling unit 40, 40" and then re-enters the system. It is worthwhile to note that the cooling fluid enters and cools the transformer 25 while the cooling fluid does not come into direct contact with the electrical current or parts of the transformer 25.

In an embodiment as shown in FIGS. 1, and 2-4, the electromagnetic oil tank heating unit 100 comprises two separate cooling units 40 and 40", wherein the cooling unit 40 supplies cooling fluid to the transformer 25 and subsequently to the induction coil 35; and wherein the cooling unit 40" supplies cooling fluid to the generator 20. However, a person skilled in the art would appreciate that a single cooling unit capable of supplying cooling fluid to all of the generator 20, transformer 25 and the induction coil 35 is also possible.

The induction plate 30 having induction coil 35 embedded therein receives current from the transformer 25 via connecting member 26 which connects the induction coil 35 with the transformer 25. The induction coil 35 emits high concentration eddy currents which heats the wall of the oil tank 55 where such heat is subsequently transferred to the oil contained inside the oil tank 55 reducing the viscosity of the oil. The induction plate 30, and thus the induction coil 35 is configured to possess a shape that corresponds to the shape of the surface of the oil tank 55 or a portion thereof of which heating is required. In this exemplary embodiment, the induction plate 30 is configured to have an arch-rectangular shape or arch-shaped to correspond the arch of the wall of a rail oil tanker 55 so as to allow good contact between the induction plate 30 and the oil tank 55. The external shell 31 of the induction plate 30 is preferably made of epoxy resin composite which is molded over the induction coil 35 to avoid electrical contact between the induction coil 35 and the wall of the oil tank 55 to avoid unwanted ignition or spark, as well as reducing possible leakage of cooling fluid.

Figure 1A:
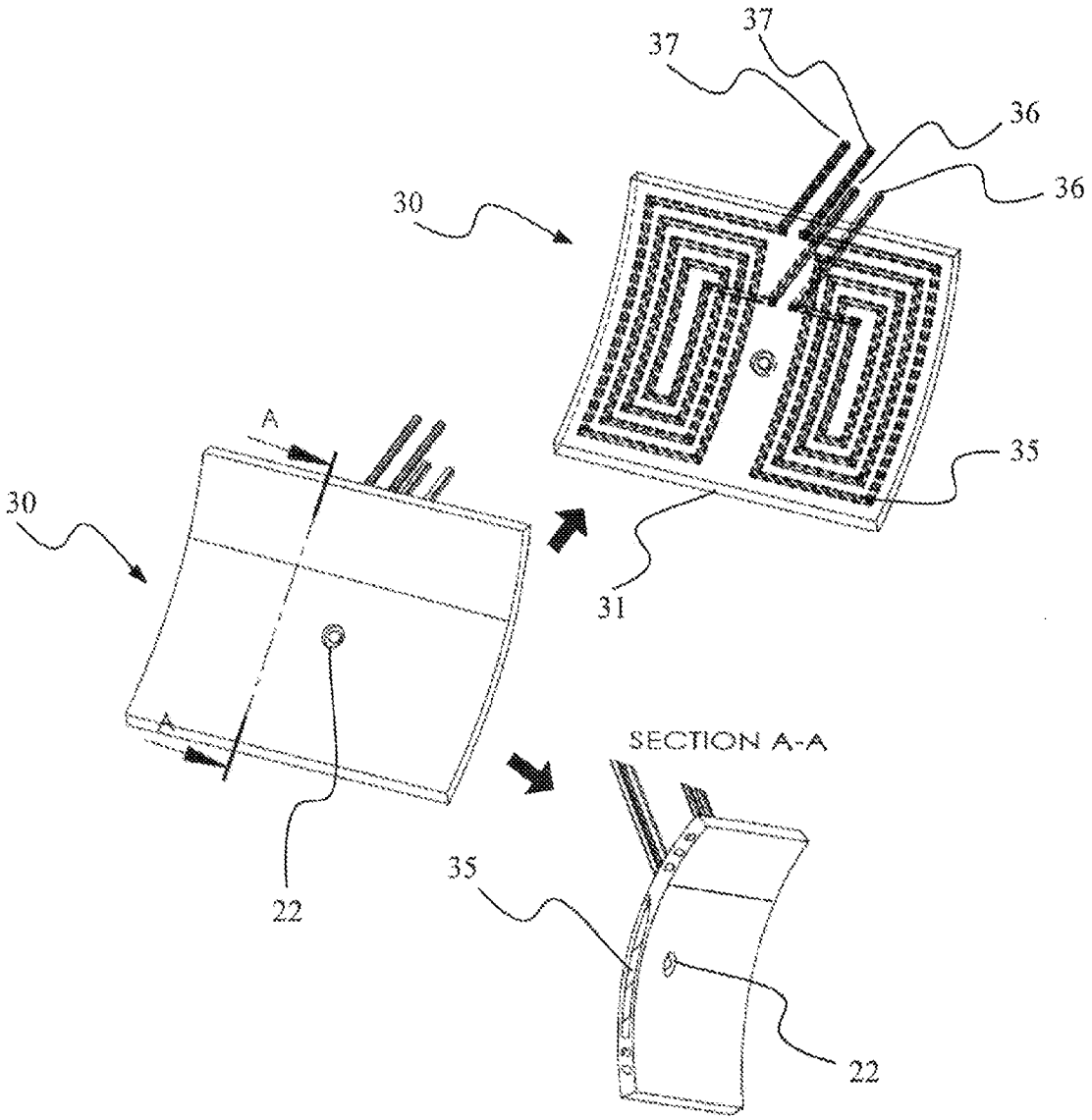
FIG. 1A show an exemplary embodiment of an arrangement of an induction coil embedded within an induction plate of the electromagnetic oil tank heating unit of the present invention and an A-A section view thereof.

FIG. 1A shows an exemplary example of the induction coil 35 embedded inside the induction plate 30. The induction coil 35 is preferably made of a hollow tube of high electrical conducting metals such as copper. In the shown example, the induction coil 35 is wound in a flat rectangular shape to correspond to the shape of the induction plate 30. The size of the coil of the induction coil 35 may be adjusted to suit the size of the area of which heating is desired. Other patterns of arrangement of the induction coil 35 is also possible. It is possible to arrange more than one set of induction coils 35 within the induction plate 30. As the frequency increases the impedance rises, therefore, the induction coil 35, with the assistance of the transformer 25, must have suitable impedance to correspond with the frequency of the generator 20. The hollow induction coil 35 is designated with a cooling fluid inlet 36 and a cooling fluid outlet 37. The cooling fluid inlet 36, is connected to and receives, via fluid inlet 36, cooling fluid from the cooling unit 40 so as to cool the induction coil 35. The cooling fluid exits the induction plate 30 via fluid outlet 37 and returns to the cooling unit 40, 40" to be cooled down once again and re-enter the induction plate 30 as a loop.

Figure 2:
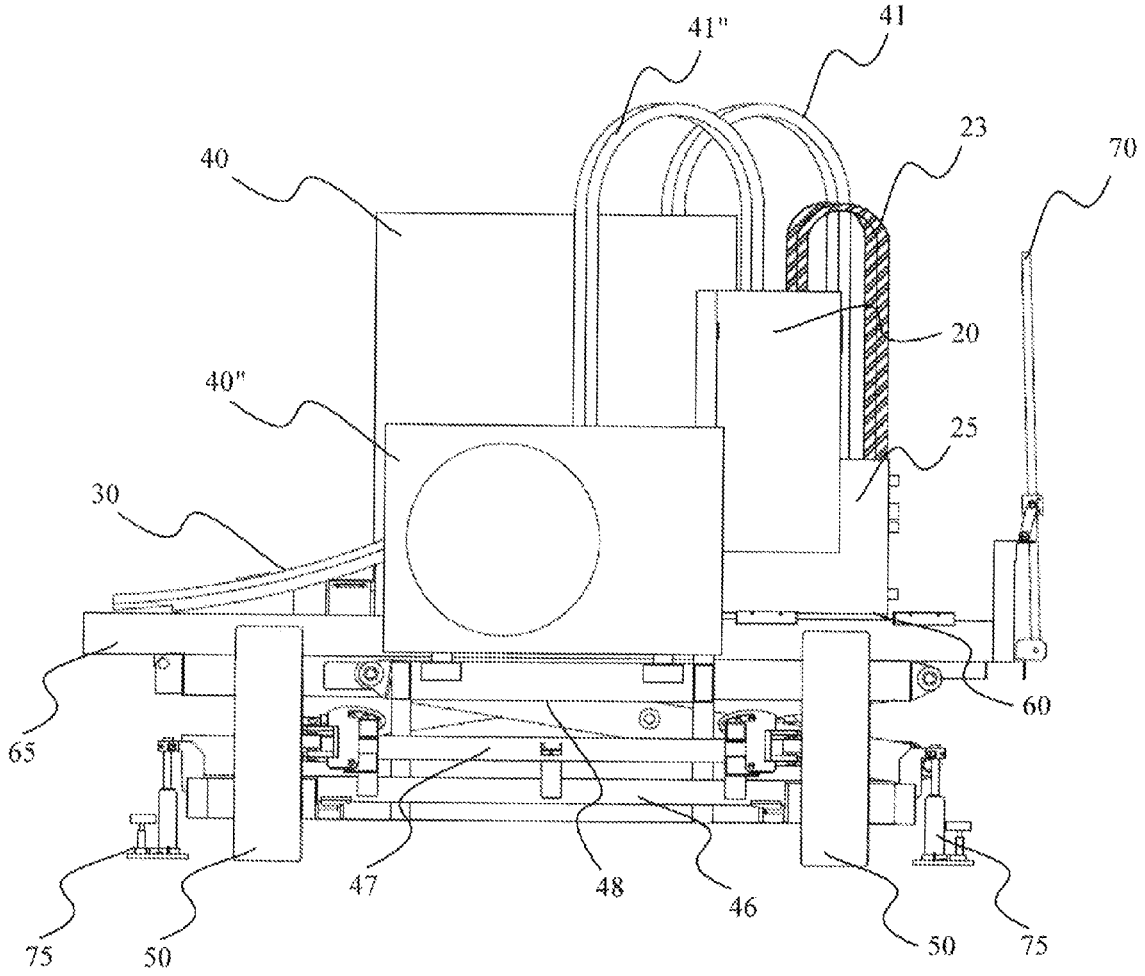
FIG. 2 shows a side view of the embodiment of the electromagnetic oil tank heating unit of FIG. 1 illustrating the unit in a collapsed position.

As previously described, the generator 20, the transformer 25, the induction plate 30 and the cooling unit 40, 40" are arranged on the frame 45. The frame 45 comprises a base frame 46 of which is a substantially rectangular shape, square shape is also possible, and an operably movable (up-down) inner frame 47 with foldable frame 48 assembled thereon. The generator 20 and the cooling unit 40, 40" are secured to designated locations on the base frame 46 away from the moving zone of the inner frame 47. The transformer 25 and the induction plate 30 connected to the transformer 25 are supported on support frame 60 of which engage to a pair opposing support railing frame 65 each of which is supported on the operably movable inner frame 47 (FIG. 1). The movable inner frame 47 is configured to move up or down so as to adjust the height of the induction plate 30 relative to the height of the area on the wall of the oil tank 55 where heating is desired. The ability to move up and down of the inner frame 47 may be by way of a mechanical means such as extendable-collapsible (foldable) frames 48 or hydraulics 49 so as to compress or extend the height of the induction plate 35 as illustrated in FIGS. 2 and 3, respectively.

Figure 3:
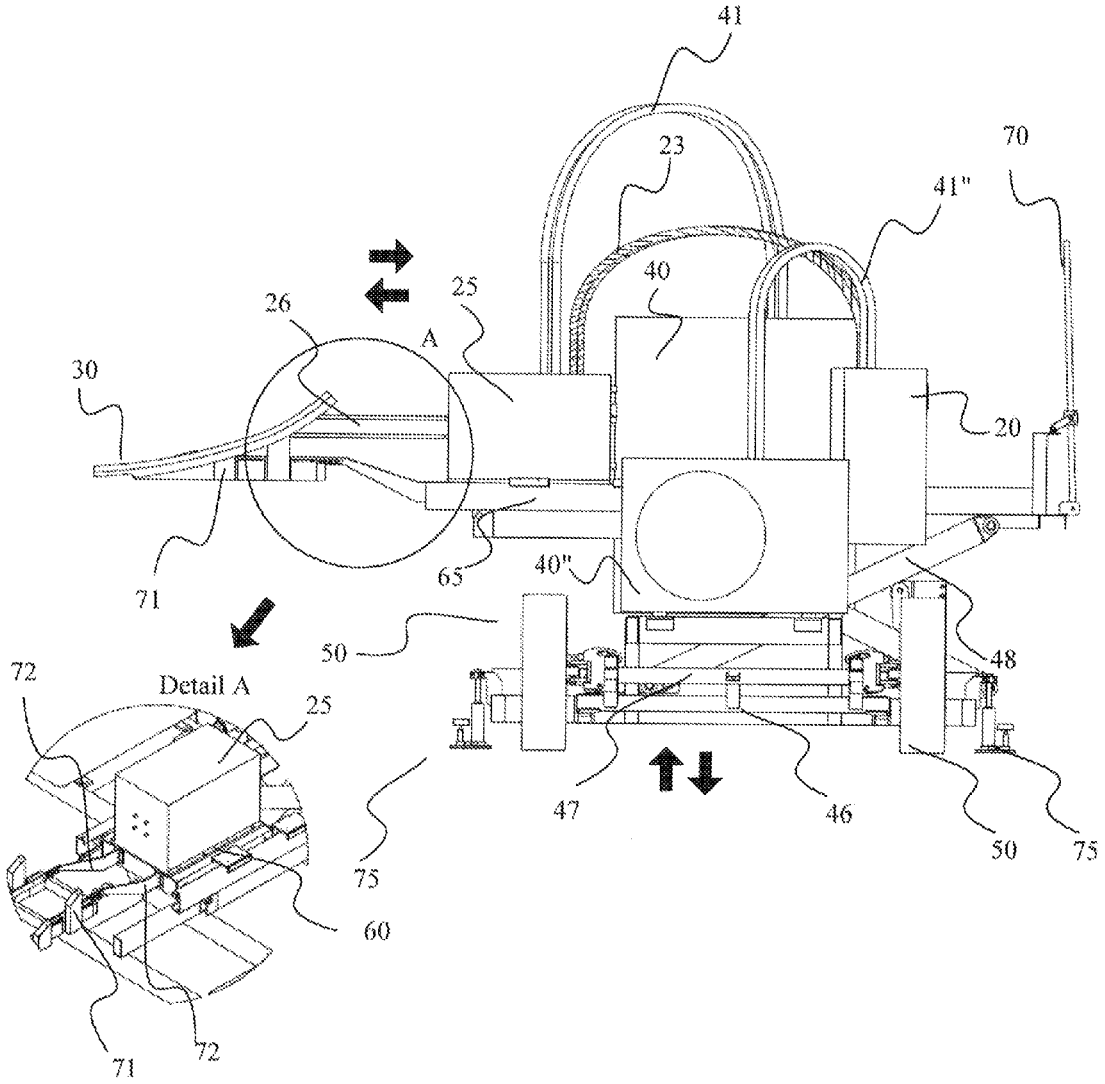
FIG. 3 shows a side view of the embodiment of the electromagnetic oil tank heating unit of FIG. 1 illustrating the unit being elevated on the frame and with a detailed illustration of the support structure of the transformer and the induction plate.
Figure 4:
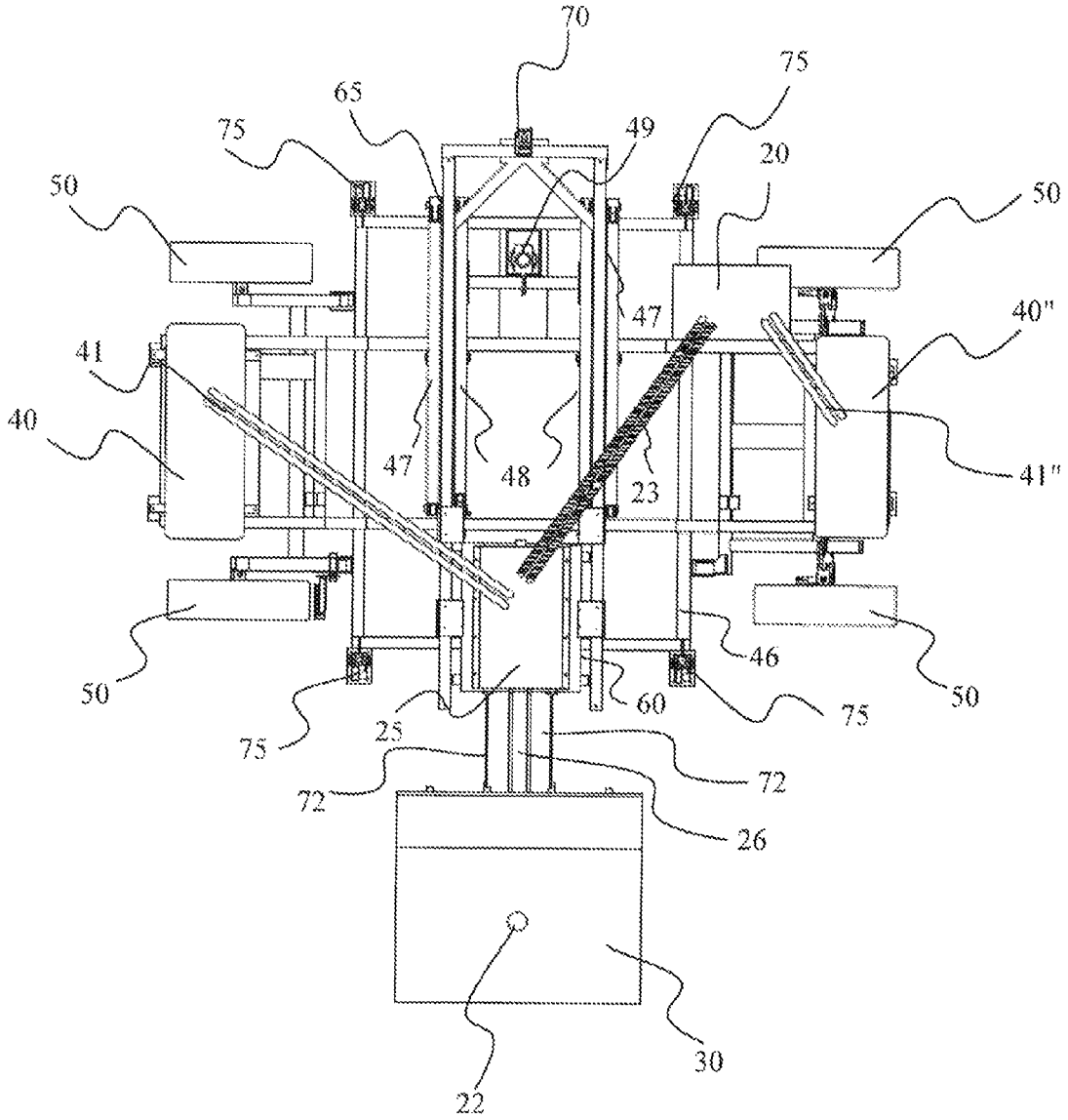
FIG. 4 shows a top plan view of the embodiment of the electromagnetic oil tank heating unit of FIG. 1 illustrating the induction plate being pushed forward.

As shown in more detail in circle Detail A in FIG. 3, the induction plate 30 and the transformer 25, while supported on the inner frame 47, is mounted on the support frame 60, made of non-conductive materials slidably mounted on a pair of railing frames 65 so as to allow the induction plate 30, while connected to the transformer 25 to move forward and backward in order to project the induction plate 30 closer to or farther away from the oil tank 55 as shown in FIGS. 3 and 4. A pair of support rods 72 connected to the support plate 30 on one end and while another end is supported on an induction plate supporter 71, which supports the weight of the induction plate 30. The induction plate 30 may be actuated to move forward or backward by way of manual operation (i.e. hand pulling or pushing), or other suitable electrical control means. An adjustable guide rod 70 is provided on and connected to the railing frame 65. The adjustable guide rod 70 is configured to finely adjust the angle of the induction plate 30 relative to the oil tank 55 in order to project the induction plate 30 at a specific posture relative to the oil tank 55. For example, the adjustable guide rod 70 may be pushed downward thereby elevating the railing frame 65 which the induction plate 30 is supported to cause the induction plate the front end, while at an extended posture as in FIG. 1 or 4 to tilt downward projecting the induction plate 30 closer to the lower section of the oil tank 55.

Other means, for example, electronic means, to move the induction plate 35 forward and backward is also possible. Other arrangements of the transformer 25 on the frame 45 and its connection with the induction plate 30 are also possible. For example (not shown), it is possible that the transformer 25 can be located at a fixed designated location (with the need to move along with the moving of the induction plate 30) on the frame 45 similar to the arrangement of the cooling unit 40, 40" and the generator 20.

The frame 45, more specifically, the base frame 47, as previously mentioned, is equipped with wheels 50 to allow mobility of the electromagnetic oil tank heating unit 100 to a desired location. Preferably, the electromagnetic oil tank heating unit 100 is equipped with wheel brakes (not shown) to ensure stability of the unit once it reaches the desired location and while the unit is in operation. The frame 45, more specifically, the base frame 47, further comprises foldable footings 75, preferably at around each corner of the base frame 47, so as to secure the heating unit 100 to the ground while the heating unit 100 is in operation.

Now turning to the second aspect of the invention, the invention discloses a stationary electromagnetic oil tank heating system configured to heat heavy oil contained inside an oil tank in one time.

Figure 5:
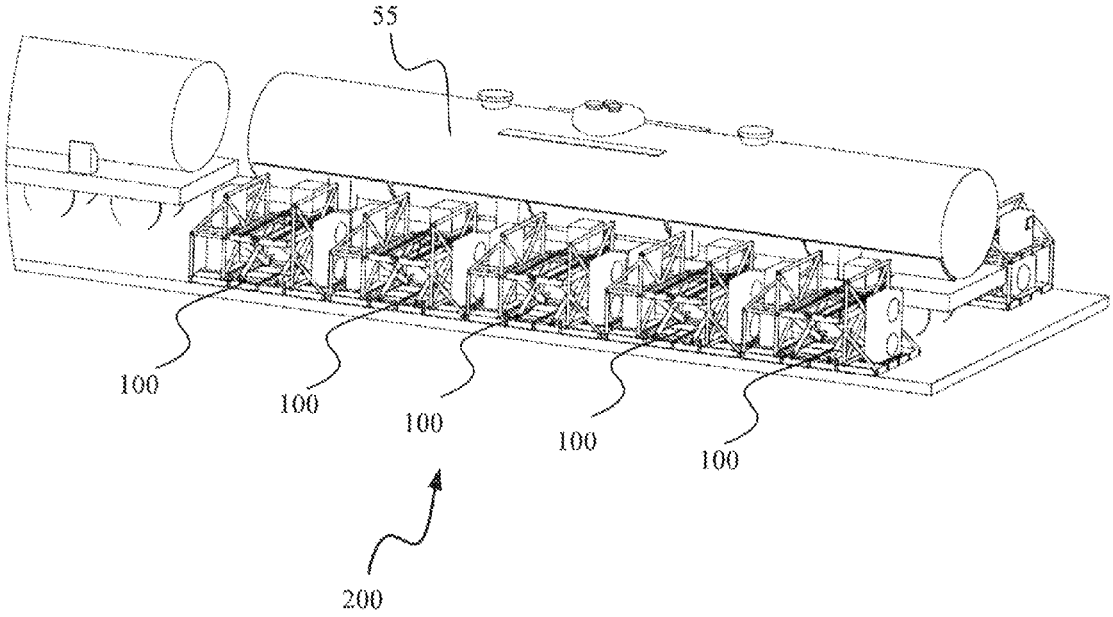
FIG. 5 shows a perspective view of a plurality of an embodiment of the electromagnetic oil tank heating units according to the present invention arranged in row along the length, on each side, of an oil tank.
Figure 6:
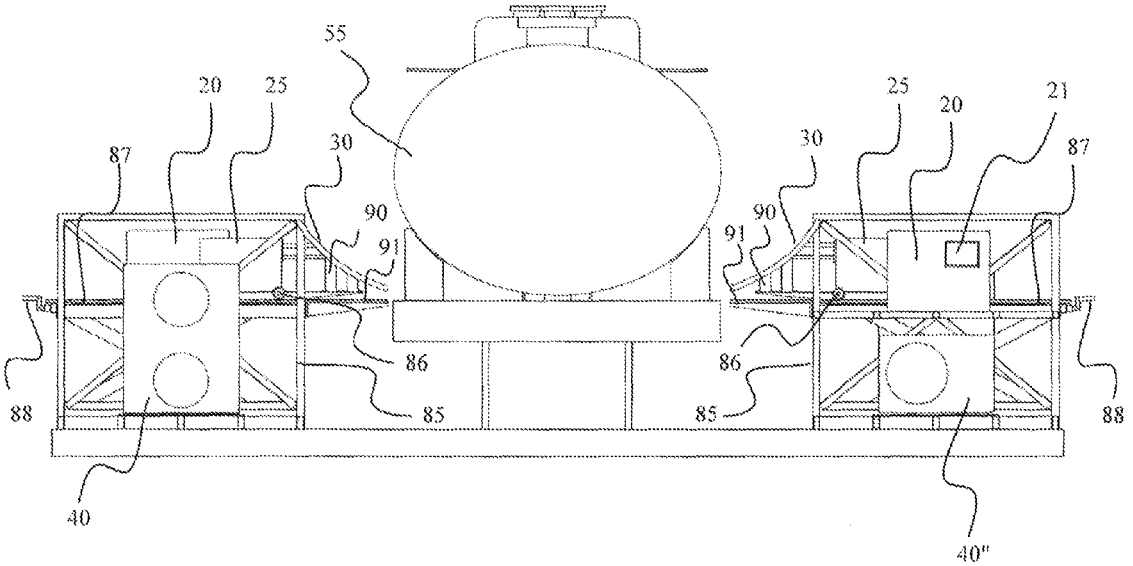
FIG. 6 shows a front elevation view of the embodiment of the electromagnetic oil tank heating unit of FIG. 5.
Figure 7:
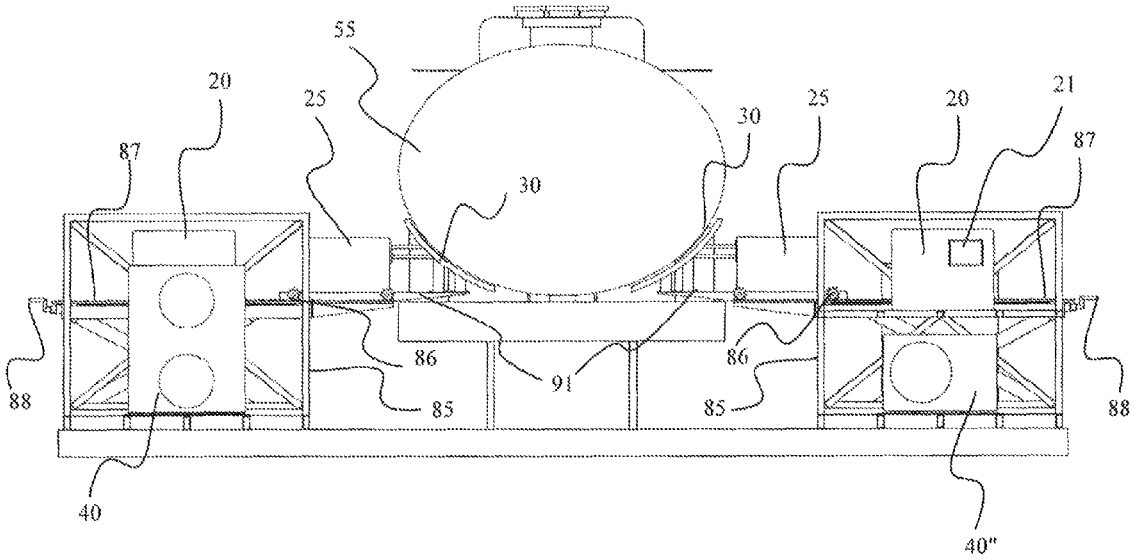
FIG. 7 shows a front elevation view of the arrangement of FIG. 6 illustrating the induction plate being extended forward to interact with the oil tank.

FIGS. 5-7 show a preferred embodiment of the electromagnetic oil tank heating system 200 according to the principle of the present invention. In this embodiment, the electromagnetic oil tank heating system 200 comprises multiple electromagnetic oil tank heating units 100, each of which similarly possesses the features and characteristics as described in the earlier described embodiment of the first aspect of the invention. However, in one embodiment of this aspect of the invention, the invention discloses an electromagnetic oil tank heating unit 100, each of which is intended to be a stationary type rather than a mobile type. Therefore, in this embodiment, the electromagnetic oil tank heating unit 100 comprises a stationary frame 85 without wheels and without footings. The generator 20, the transformer 25, the cooling unit 40, 40" and the induction plate 30 are assembled on to the frame 85 as in the previously described embodiment. FIG. 5 shows an exemplary arrangement of the electromagnetic oil tank heating system 200 comprising a plurality of electromagnetic oil tank heating units 100 of which without wheels and without footings, are fastened or secured to the ground. Each unit is arranged side by side to the next and subsequent units along the length, and on each side of the oil tank 55. The induction plate 30 of each of the electromagnetic oil tank heating units 100 is maneuvered forward to project the induction plate to the wall of the oil tank 55 so as to heat the wall of the oil tank 55 as shown FIGS. 6-7. In the embodiment of the oil tank heating unit 100 as shown in FIGS. 6 and 7, the transformer 25 and the induction plate 30 connected to the transformer 25 are supported on support 90 and support 91, on the transformer and the induction plate 30. The railing frame 87, having a support 90 and a support 91 disposed thereon, to provide support to the induction plate 30 and the transformer 25. In this embodiment, the transformer 25 is equipped with wheels 86 and configured to be movable along a railing 87. The wheels 86 are disposed front and to the rear (relative forward and backward moving direction of the transformer 25 and the induction plate 30) of the transformer 25. The wheels 86 move along a groove or channel (not shown) prepared on each of the railings 87. The groove or the channel restricts the wheels 86 to move in a straight line only and hence avoid derailment of the moving transformer 25 and the induction plate 30.

As also shown in FIGS. 5-7, the oil tank heating unit 100 is prepared with a different configuration of the handle. In this embodiment, the handle is realized as an adjustable handle 88 which serves the same function as with the adjustable guide rod 70 of the earlier described embodiment, see FIG. 1. That is, the handle 88 serves to finely adjust the transformer 25 and the induction plate 30 to project at the required angle relative to the oil tank 55.

This embodiment and its arrangement as described, is particularly useful for drive-through stationary heating of the oil tank 55 wherein the oil tank to be heated is driven (while on an oil tanker) into a position and driven away once the heating is completed. The same principle may also be utilized for a rail tanker wherein multiple units of the electromagnetic oil tank heating unit 100 are lined along the tanker platform and once the rail tanker is moved into position, the induction plate 30 is moved forward to heat the lower portion of the oil tank 55 and is retracted backward once the heating is completed to enable the rail tanker to move and drive the oil tank 55 away from the station.

Figure 8:
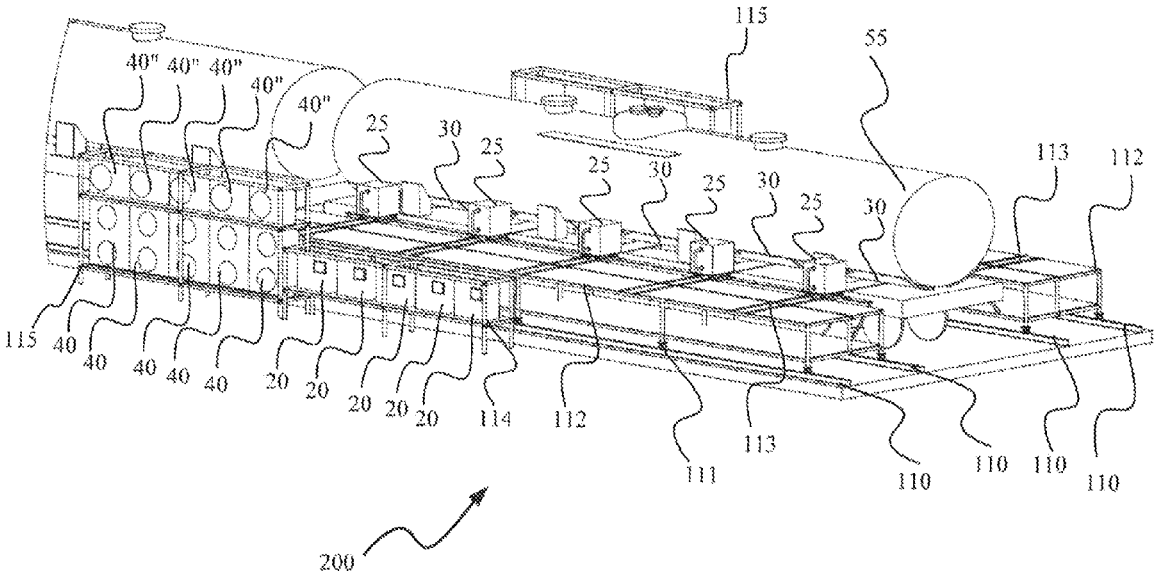
FIG. 8 shows a perspective view of an embodiment of the electromagnetic oil tank heating unit of which the generator, the transformer and the cooling unit are arranged in a central station away from the induction plate supported on a frame.
Figure 9:
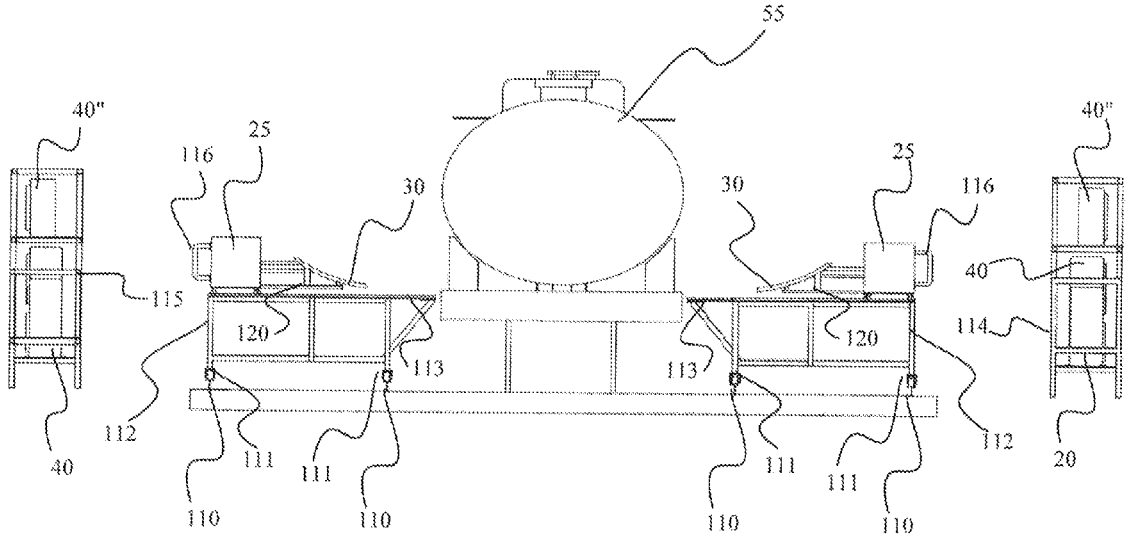
FIG. 9 shows a side elevation view of the embodiment of the electromagnetic oil tank heating unit of FIG. 8 of which the induction plate is in a normal position.
Figure 10:
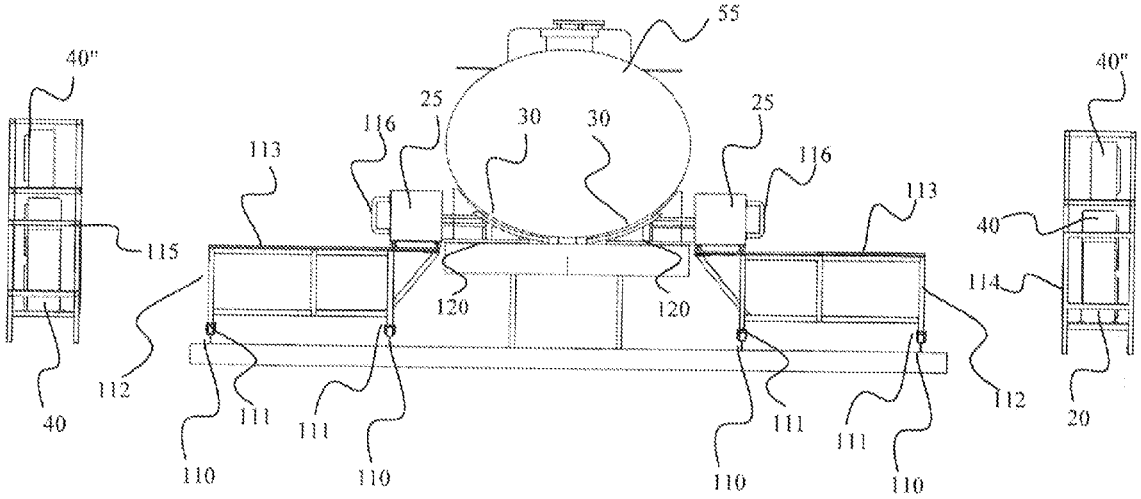
FIG. 10 shows a side elevation view of the embodiment of the electromagnetic oil tank heating unit of FIG. 9 of which the induction plate is moved forward to heat the oil tank.

FIGS. 8-10 show another preferred embodiment of the electromagnetic oil tank heating system 200 according to the principle of the present invention. This embodiment is also intended to be a stationary system in which the system comprises a plurality of oil tank heating units 100 arranged side by side subsequent to the next unit along the length of the oil tank 55 on a pair of opposing, paralleled station rails 110. In this embodiment, the cooling unit 40, 40" and the generator 20 are not mounted onto a frame 112 equipped with wheels 111 so as to move the unit along the rail 110. In this embodiment, the cooling unit 40, 40" are supported on a cooling unit support frame 115 and the generators 20 are arranged on a generator support frame 114 at a central location away from the frame 45 on which the transformer 25 and the induction plate 30 are supported. The transformer 25 and the induction plate 30 communicate with the cooling unit 40, 40" and generator 20 via cables, preferably underground [not shown].

Again, in this embodiment, the electromagnetic oil tank heating system 200 comprises multiple units of electromagnetic oil tank heating units 100 of which are arranged in a stationary type arrangement. In this embodiment, each of the electromagnetic oil tank heating units 100 still comprise the main features and characteristics of generator 20, the transformer 25, the induction plate 30, the induction coil 35 and the cooling unit 40, 40" as described in earlier embodiments. However, this embodiment is characterized from the previous embodiments in that only the transformer 25 and the induction plate 30 are supported on the frame 45. The transformer 25 and the induction plate 30 are correspondingly connected to the respective generator 20 and the respective cooling unit 40, 40" via cables and tubes (not shown) at a central station away from the frame 45 on which the transformer 25 and the induction plate 30 are supported. Similar to the second embodiment, as previously described in relation to FIGS. 5-7, the induction plate 30 of each of the electromagnetic oil tank heating units 100 is maneuvered forward or backward to project the induction plate 30 toward or away from the wall of the oil tank 55 so as to heat the wall of the oil tank 55 as shown in FIGS. 9-10. Further in this embodiment, the frame 45 is prepared as a rigid frame and is not intended to collapse and extend in order to move the induction plate 30 up or down. In this embodiment, the frame 45 is more like a table of which the transformer is supported thereon.

As shown in FIG. 9, the transformer 25 is communicated with the induction plate 30, and a support member 120, of which is engaged to the transformer 25 and is provided to support the induction plate 30. The bottom of the transformer 25 is equipped with wheels disposed to the front and to the rear of the transformer 25 (relative forward and backward moving direction of the transformer 25 and the induction plate 30) which move along a pair of spaced-apart paralleled grooves or channels 113 prepared on the surface of the top of the frame 45. The transformer 25 is prepared with a hand rail 116 for maneuvering the transformer 25 and the induction plate 30 forward or backward along the said groove or channels 113. Also, this embodiment and its arrangement as described, is particularly useful for drive-through stationary heating of the oil tank 55 wherein the oil tank to be heated is driven (while on an oil tanker) into a position and driven away once the heating is completed. The same principle may also be utilized for rail tankers wherein multiple units of the electromagnetic oil tank heating unit 100 are lined along the train platform and once the rail tanker is moved into position, the induction plate 30 is moved forward to heat the lower portion of the oil tank 55 and is retracted backward once the heating is completed to enable the rail tanker to move and drive the oil tanker 55 away from the station. Further, in the embodiment as illustrated in FIGS. 9-10, the frame 45 may be prepared without the extendable and collapsible inner frame 47 and foldable frame 48. Utilization of the electromagnetic oil tank heating unit 100 without the ability to adjust the height of the induction plate 30 is possible where the oil tanks 55 to be heated are of uniform height. For example, the oil tank for a rail oil tanker in most instances is positioned onto the rail oil tanker at specific predetermined height. Accordingly, the induction plate 30 may be supported on the frame 45 at a fixed height such that the induction plate 30 can be projected at specific portion of the oil tank 55, for example a lower portion of the oil tank 55. Therefore, in such cases, adjusting the height of the induction plate 30 by height adjusting means is not a necessary feature. Hence the frame 45 may be prepared without the inner frame 47.

Further, it is possible to also provide the cooling unit with higher capacity such that a single unit of the cooling unit 40 is able to supply cooling fluid to multiple units of transformer and/or generators. Similarly, the generator with higher capacity may also be connected to multiple units of transformers.

Further, it is possible to also provide different configurations of the elements and features to achieve the same object of providing heating in order to reduce viscosity of heavy oil. That is the principle of electromagnetic oil tank heating according to the principle of the present invention may not necessarily be limited to heating oil tanks only, but may be also applied for heating other oil containing, oil carrying, and oil transporting vessels. For example, the heating unit, especially the induction plate, may be prepared to heat different kinds of vessels, such as above ground oil pipelines, wherein the induction plate may be prepared as a clamp of which it is configured to clamp onto the pipeline and heat the pipeline.

It will be appreciated from the teachings of the principles of the invention described above that various modifications to specific features and arrangements, shapes and configurations of the essential elements of the component of the electromagnetic oil tank heating unit are possible. Such modifications are within the scope of the present invention.

We claim:

1. An electromagnetic oil tank heating unit comprising:

a generator (20) comprising a temperature control unit for generating high frequency electrical current;

a transformer (25) connected to the generator (20) and receives electrical current from the generator (20);

an induction plate (30) supported on an induction plate supporter (71, 91), said induction plate having at least one unit of induction coil (35) embedded therein connected to the transformer (25) and configured to receive high concentration current and cooling fluid from the transformer (25);

at least one cooling unit (40, 40") connected to and configured to supply cooling fluid to the generator (20) and the transformer (25);

a frame (45) of which the generator (20), the transformer (25), the induction plate (30) and the cooling unit (40, 40") are supported thereon; and an adjustable guide rod or adjustable handle (70, 88) disposed on the frame, said adjustable guide rod or adjustable handle (70, 88) configured to adjust the angle of the induction plate (30) relative to the wall of the oil tank (55);

wherein the transformer (25) and the induction plate (30) are configured to operably move forward and backward on the frame to project toward or away from a wall of an oil tank to be heated.

2. The electromagnetic oil tank heating unit (100) according to claim 1, wherein the frame (45) is configured to be extendable and collapsible for maneuvering the induction plate (30) disposed on the said frame (45) to move up or down.

3. The electromagnetic oil tank heating unit according to claim 2, wherein the induction plate (30) further comprising an embedded epoxy resin composite shell of the induction plate (30); and the induction plate (30) receives current from the transformer (25) via a connecting member (26) which connects the induction coil (35) with the transformer (25).

4. The electromagnetic oil tank heating unit (100) according to claim 3, wherein the induction coil (35) is made of hollow, high electrical conducting metals configured to receive cooling fluid from the cooling unit (40) via designated cooling fluid inlet (36) so as to cool the induction coil (35) and discharges the cooling fluid via designated cooling fluid outlet (37).

5. The electromagnetic oil tank heating unit (100) according to claim 4, wherein the induction plate (30) comprising a temperature sensor (22) disposed at the induction plate (30).

6. The electromagnetic oil tank heating unit (100) according to claim 1, where in the frame (45) is equipped with wheels (50) mounted to the frame (45) permitting the maneuvering of the oil tank heating unit.

7. The electromagnetic oil tank heating unit (100) according to claim 1, wherein the frame (45) is equipped with footings (75) disposed at the frame (45) and configured to permit securing the oil tank heating unit (100) to the ground.

8. The electromagnetic oil tank heating unit (100) according to claim 5, wherein the frame (45) is equipped with footings (75) disposed at the frame (45) and configured to permit securing the oil tank heating unit (100) to the ground.

9. The electromagnetic oil tank heating unit (100) according to claim 6, wherein the frame (45) is equipped with footings (75) disposed at the frame (45) and configured to permit securing the oil tank heating unit (100) to the ground.

10. The electromagnetic oil tank heating unit (100) according to claim 1, wherein the induction plate (30) is arc-shaped corresponding to the shape of the lower portion of an oil tank.

11. The electromagnetic oil tank heating unit (100) according to claim 7, wherein the induction plate (30) is arc-shaped corresponding to the shape of the lower portion of an oil tank.

12. The electromagnetic oil tank heating unit (100) according to claim 7 comprising an adjustable guide rod or adjustable handle (70, 88) disposed on the frame, said adjustable guide rod or adjustable handle (70, 88) configured to adjust the angle of the induction plate (30) relative to the wall of the oil tank (55).

13. The electromagnetic oil tank heating unit (100) according to claim 1, wherein the transformer (25) is equipped with wheels (86), said wheels (86) configured to move along a corresponding groove/channel prepared on each of the railing frame (65, 87) or a pair of spaced apart grooves/channels (113) prepared on a top surface of the frame 112 permitting maneuvering of the transformer (25) having the induction plate (30) connected thereto to move forward or backward.

14. The electromagnetic oil tank heating unit (100) according to claim 1, wherein the transformer (25) is equipped with wheels (86), said wheels (86) configured to move along a corresponding groove/channel prepared on each of the railing frame (65, 87) or a pair of spaced apart grooves/channels (113) prepared on a top surface of the frame 112 permitting maneuvering of the transformer (25) having the induction plate (30) connected thereto to move forward or backward.

15. The electromagnetic oil tank heating unit according to claim 13, wherein the transformer comprises a hand rail (116) permitting maneuvering the transformer (25) forward or backward.

16. An electromagnetic oil tank heating system (200) comprising a plurality of electromagnetic oil tank heating units (100) according to claim 1 arranged side by side along the length, and one each side of the oil tank (55); each of the electromagnetic oil tank heating units (100) having the generator (20), the transformer (25), the induction plate (30) and the cooling unit (40, 40") supported on a frame (45, 85); and each electromagnetic oil tank heating unit is configured to heat the oil tank (55) simultaneously or sequentially.

17. An electromagnetic oil tank heating system (200) comprising a plurality of electromagnetic oil tank heating units (100) arranged side by side along the length, and one each side of an oil tank (55); each of the electromagnetic oil tank heating units (100) comprising:

a generator (20) comprising a temperature control unit for generating high frequency electrical current;

a transformer (25) connected to the generator (20) and receives electrical current from the generator (20);

an induction plate (30) having at least one unit of induction coil (35) embedded therein connected to the transformer (25) and configured to receive high concentration current and cooling fluid from the transformer (25);

at least one cooling unit (40, 40") connected to and configured to supply cooling fluid to the generator (20) and the transformer (25); and a frame (112) of which the generator (20), the induction plate (30) and the cooling unit (40, 40") are supported thereon;

wherein the transformer (25) and the induction plate (30) are configured to operably move forward and backward on a groove or channel (113) prepared on the frame (112) to project the induction plate (30) toward or away from a wall of an oil tank; and wherein the generator (20) and the cooling unit (40, 40") are centrally located away from the frame (45); and the frame (112) is equipped with wheels (112) of which is configured to move along rails (110) to permit the oil tank heating unit to move along the length of the oil tank 55 along the rails (110).

* * * * *